US005920197A

United States Patent [19]

Price et al.

[11] Patent Number: 5,920,197

[45] Date of Patent: Jul. 6, 1999

[54] SENSOR FOR DETECTING THE PRESENCE OF A PERIPHERAL DEVICE

[75] Inventors: Noah M. Price, Campbell; Laurence A. Thompson, Saratoga; Gary L. Baker, Watsonville, all of Calif.

[73] Assignee: Apple Computer, Inc., Cupertino, Calif.

[21] Appl. No.: 08/512,170

[22] Filed: Aug. 7, 1995

[51] Int. Cl.[6] ..... H01H 31/04

[52] U.S. Cl. ..... 324/538; 324/415; 324/126

[58] Field of Search ..... 324/538, 500, 324/537, 539; 72/4, 31

[56] References Cited

FOREIGN PATENT DOCUMENTS

| | | | |
|---|---|---|---|
| 62-148866 | 7/1987 | Japan | 324/538 |
| 2-54181 | 8/1988 | Japan | 324/538 |

OTHER PUBLICATIONS

Switchcraft product reprint, from MCM Electronics, 650 Congress Park Dr., Centerville, OH 45459, catalog 29, p. 169, Jul. 1992.

*Primary Examiner*—Josie Ballato
*Assistant Examiner*—Thomas Valone
*Attorney, Agent, or Firm*—Burns, Doane, Swecker & Mathis, L.L.P.

[57] ABSTRACT

A sensor is provided for automatically detecting the presence or absence of an electronic device which interfaces with other devices via an information signal. The sensor comprises a receiving connector which receives a mating connector associated with the electronic device to electrically and physically connect the device to the sensor and to another device. The receiving connector includes a terminal to which the information signal is applied. The sensor also comprises a sensing circuit connected to the terminal of the receiving connector for detecting whether the information signal is present at the terminal. The sensing circuit generates an output signal which indicates when a mating connector is received within the receiving connector, and thus whether the electronic device is present, in dependence upon whether the information signal is detected at the terminal. In one embodiment, the sensing circuit comprises a low-pass analog filter connected to a switching transistor for generating a signal at two logic levels. The two logic levels respectively indicate whether or not a mating connector is received within the receiving connector, and thus whether or not the electronic device is present.

14 Claims, 2 Drawing Sheets

SENSOR FOR DETECTING THE PRESENCE OF A PERIPHERAL DEVICE

BACKGROUND OF THE INVENTION

1. Field of the Invention

The present invention relates to the field of electronic devices, and more particularly to physical and electrical connections between electronic devices.

2. Background of the Related Art

As electronic systems grow more powerful and complex, the need for seamless interaction between electronic components takes on increasing significance. Today countless man-hours are dedicated to the design of systems in which diverse components function together flawlessly without a user's giving a moment of thought to the inner workings of the components or to the complex interfacing between them.

This is particularly true in the world of personal computing. A clear example occurs in the everyday situation in which a business person uses a personal computer for the purpose of desktop publishing. Such a user is concerned only with the business task at hand, and has no interest in the precise technical interaction between the base system processor, keyboard, display terminal, and disk drives. Any problem resulting from incompatibility between those components not only causes the user consternation, but also results in loss of productivity and decreased cost efficiency.

One such problem often arises when multiple display devices are connected to a single base processor within a personal computer system. Such a configuration might be used, for example, by a business person making an audio-visual presentation. In that case, one display device might reside physically near the base processor for use by the individual making the presentation, while other display devices might be situated such that the presentation may be seen by a large group of people. No matter the specific application, however, a user of a multiple-display system should not have to be concerned with how, or when, a particular display device is connected to the base system processor. Unfortunately, this is not always so, and multiple-display arrangements often lead to difficulty.

For example, problems can arise in the common situation in which a personal computer user interfaces with the computer by manipulating an electro-mechanical "mouse" to move a corresponding video cursor among various user-selectable menu options projected on a display device. If two or more display devices are connected to the system processor, and each device displays different user-selectable menu options, the user may wish to "drag" an interface component, such as a menu, from one display device to another. Should a display device be disconnected from the processor while that device is actively displaying the interface component, the user may no longer be able to select menu items and the system could be inoperative. Once again, such an occurrence results in lost productivity and may constitute an unacceptable deficiency in an otherwise "user friendly" system.

This problem would be alleviated if means were provided by which the software running on a base system processor for configuring the use interface could be provided information pertaining to the presence or absence of a peripheral display device. If such means existed, then the software could, upon detecting that an active display device had been disconnected, redirect the user interface component to any still-connected display device and remain in a fully operative state. Such a "peripheral device sensor" would provide a user with worry-free connectivity between components and would represent a significant improvement over the prior art. However, because the typical video display device is passive, meaning that it receives an input signal without transmitting information back to the source of that signal, automatic detection of peripheral display devices is not readily achieved. More importantly, prior art approaches to the detection of passive devices prove unsatisfactory in this context.

In some prior art approaches, electronic devices are coupled by means of application-specific connectors that include special-purpose switches or data lines for automated device detection. Thus, the prior art connectors contain hardware or circuitry that is not otherwise necessary for communication between coupled devices, and therefore represents an undesirable expense. While a custom connector for coupling a video display device with a base system processor could be constructed to include device detection circuitry in addition to the simple data and grounding lines required for video signal transmission, development of such a specialized connector is neither practical nor desirable. This is particularly true where the video signal is a composite analog signal that requires a two-line connector such as an RCA jack.

Connectors now used with video display devices are standard across the industry. A change in connector style would require that a new standard be set, and given the vast number of connectors already in use, such a changeover is quite improbable. Even if an industry-wide transition were plausible, it would not be advisable. Today's video connectors are appropriately simple, inexpensive, and easy to use, and the higher production and retail costs that would accompany even a modest increase in connector complexity would be prohibitive. Thus, there is a pressing need for a method and an apparatus by which an electronic device, such as a computer processor, can automatically detect whether or not it is coupled with another electronic device, such as a video display, without requiring that a non-standard, or special-purpose, connector be used.

Another prior art approach uses standard connectors to detect the presence of remote audio devices, such as headphones for example. In this approach, when a remote device is not present, the audio signal is provided to one terminal of a voltage divider, causing the divider to produce a particular output voltage. If a remote devices is connected, the audio signal is disconnected from the divider, causing it to produce a different output voltage. The difference between these two output voltages can be sufficient to be compatible with TTL logic circuitry, e.g., it could be on the order of several volts, and thereby provide useful information to configuration software.

However, this approach is not suitable for use with a signal such as a video signal, for example, which effectively comprises a somewhat random AC signal with a DC offset that causes the entire signal to be positive, e.g., the signal varies in a range of 0–2 volts. Because of the nature of this signal, the voltage divider approach does not produce a sufficiently large enough voltage swing to produce a TTL-level compatible signal.

Accordingly, it is desirable to provide a means by which a monitor or similar device which employs an information signal such as a video signal can be detected without requiring the use of special connector components for such a function.

SUMMARY OF THE INVENTION

The present invention fulfills the above-described and other needs by providing a sensor for detecting the presence of an electronic device to which an information signal is provided. The sensor comprises a receiving connector which couples with, or receives, a mating connector associated with the electronic device to electrically and physically connect the device to a source of the information signal. The receiving connector includes a first terminal to which the information signal is applied and a second terminal that is selectively connected to the first terminal in dependence upon whether a mating connector is coupled to the receiving connector. The sensor also comprises a sensing circuit connected to the second terminal of the receiving connector for detecting whether the information signal is present at the second terminal. The sensing circuit generates a signal which indicates whether a mating connector is received within the receiving connector, and thus whether the electronic device is coupled to the information signal, in dependence upon whether the information signal is detected at the second terminal. In one embodiment of the present invention, the sensing circuit comprises a low-pass analog filter connected to a switching transistor for generating a signal at two logic levels. The two logic levels respectively indicate whether a mating connector is received within the receiving connector, and thus whether the electronic device is coupled to the source of the information signal.

The advantages, features, and objects of the present invention will become more apparent from the following detailed description of the present invention when taken in conjunction with the accompanying drawings. Note that, although the background of the present invention has been developed with respect to video display devices, the present invention is readily applicable to any type of electronic device to which an information signal is provided.

BRIEF DESCRIPTION OF THE DRAWINGS

FIG. 2-*b* shows an approximation of another standard device connector known in the prior art.

DETAILED DESCRIPTION OF THE PREFERRED EMBODIMENTS

Figure 1:
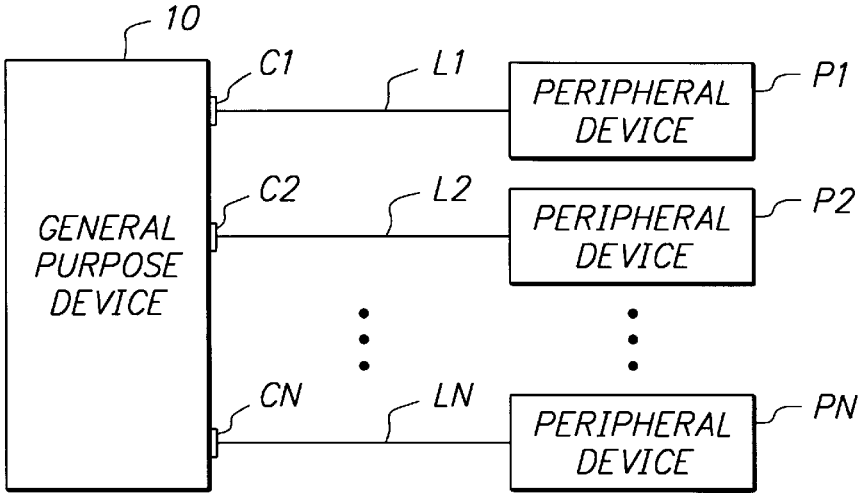
FIG. 1 PRIOR ART
FIG. 1 depicts a generic configuration of electronic devices as is typical in the prior art.

FIG. 1 is a block diagram representing a generic arrangement of electronic devices. In that arrangement, an arbitrary number of peripheral devices P1–PN are coupled with, or connected to, a general purpose device 10 by means of respective interface lines L1–LN and connectors C1–CN. The general purpose device 10 may be any known electronic device, for example a computer processor or a telephone switching device. Likewise, each of the peripheral devices P1–PN may be any electronic device capable of interface with the general purpose device 10. For example, if the general purpose device 10 is a telephone switching device, then the peripheral devices P1–PN might be telephones or telephone answering machines. Alternatively, if the general purpose device 10 is a computer processor, then the peripheral devices P1–PN might be video displays, telephone modems, or data storage devices.

Whatever the particular devices may be, each of the lines L1–LN represents the communication channel, or channels, necessary for proper interface between the general purpose device 10 and a corresponding one of the peripheral devices P1–PN. Similarly, each of the connectors C1–CN represents the hardware necessary for coupling the general purpose device 10 to a respective one of the lines L1–LN. Thus, information signals passing between the general purpose device 10 and a particular peripheral device are transmitted by means of a connector and a communication line, or lines, associated with that particular device.

As was discussed with respect to the background of the present invention, it is often desirable that a device such as the general purpose device 10 be able to automatically detect the presence or absence of each coupled peripheral device. However, as was also previously discussed, some connectors used for coupling devices are typically simple in form and standardized across industries, and redesign of such connectors for automated device detection is not practical or desirable.

Figure 2A:
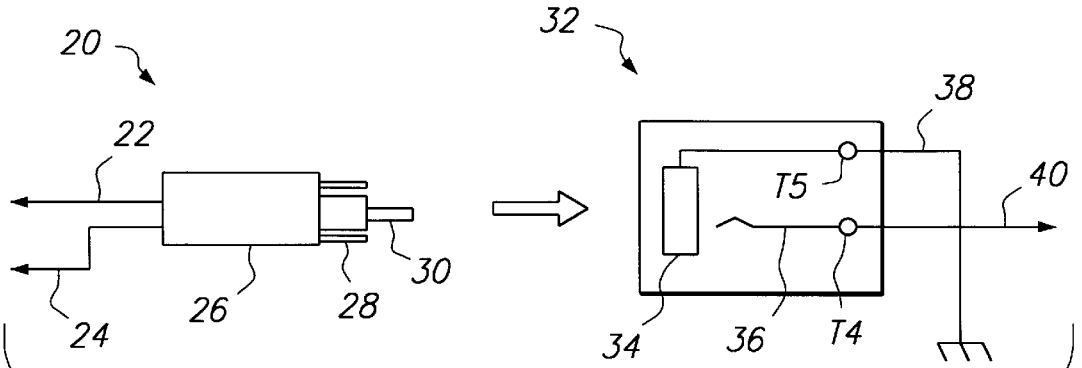
FIG. 2A PRIOR ART
FIG. 2-*a* shows an approximation of a standard device connector known in the prior art.
Figure 2B:
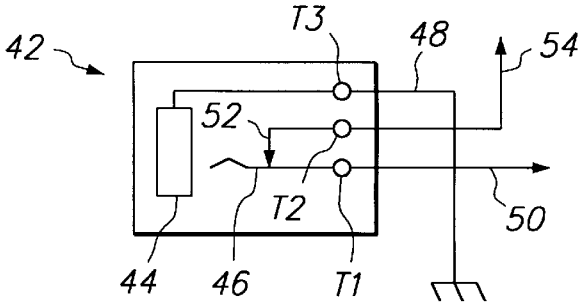
FIG. 2B PRIOR ART

For purposes of illustration and discussion only, it will be assumed that the general purpose device 10 is a computer processor and that the peripheral devices P1–PN are video display devices, e.g., televisions, digital monitors, and the like. In the case of analog devices, only two hardware channels, actually wires, are necessary for proper communication between devices. Namely, a transmission wire is required for carrying a video information signal from a computer to a display device, and a grounding wire is required for connecting the computer and the display device to a common electrical ground. FIG. 2-*a* shows an approximation of a standard connector used to couple a video display device to a computer processor, or to any other video information signal source. A connector such as that shown in FIG. 2-*a* is commonly referred to in the industry as an "RCA jack" or as an "RCA" connector.

The connector of FIG. 2-*a* is comprised of a male, or mating, component 20 and a female, or receiving, component 32. The male component 20 is comprised of a conducting tip 30, an insulator 26, a grounding band 28, a transmission wire 22, and a grounding wire 24. The transmission wire 22 makes electrical contact with the conducting tip 30 inside of the insulator 26. At the same time, the grounding wire 24 makes electrical contact with the grounding band 28 inside of the insulator 26. The insulator 26 is constructed such that the transmission wire 22 and the conducting tip 30 remain electrically insulated from the grounding wire 24 and the grounding band 28. The female component 32 of the connector is comprised of a leaf contact 36, a grounding receptacle 34, a transmission wire 40, and a grounding wire 38. The leaf contact 36 makes electrical contact with the transmission wire 40 at an electrical terminal T4, and the grounding receptacle 34 makes electrical contact with the grounding wire 38 at an electrical terminal T5.

The simple construction of the connector of FIG. 2-*a* allows for easy coupling between a video display device and a computer processor. When the male component 20 is physically coupled with the female component 32, the conducting tip 30 makes electrical contact with the leaf contact 36, and the grounding band 28 makes electrical contact with the grounding receptacle 34. Thus, a video information signal provided by a computer processor on the transmission wire 40 may be passed to a video display input connected to the transmission wire 22. Also, if the computer processor is electrically grounded to the grounding wire 38 and the video display device is electrically grounded to the grounding wire 24, then the computer processor and the video display device will share a common electrical ground, as is preferred for proper video transmission.

FIG. 2-*b* depicts an approximation of a female component 42 of another connector that is standard in the industry. The male component of such a connector could be identical to that of the connector of FIG. 2-*a* and is not shown. The female component 42 also comprises parts analogous to the female component 32 of FIG. 2-*a*, and they are not described again here. However, the female component 42 additionally comprises a point contact 52 which makes electrical connection with a contact wire 54 at an electrical terminal T2. When the male and female components of the connector of FIG. 2-*b* are not physically coupled, the point contact 52 makes electrical connection with the leaf contact 46 so that a signal provided on the transmission wire 50 passes through to the contact wire 54. When the male and female components of the connector are physically coupled, a conducting tip of the male component makes contact with the leaf contact 46 and deflects the leaf contact 46 so that it ceases to make electrical connection with the point contact 52. Thus, a signal provided on the transmission wire 50 passes to the conducting tip of the inserted male connector component, but will not pass through to the contact wire 54. This type of connector is commonly used to "turn off" one device when another device is in use. For example, in an audio application, a speaker connected to the contact wire 54 receives an audio information signal applied to the transmission wire 50 so long as no male connector component is plugged into the female component 42. However, if a male connector component, perhaps associated with a set of audio headphones, is plugged into the female component 42, the speaker no longer receives the audio signal.

As the foregoing discussion makes clear, video devices and computer processors may be coupled by means of very basic standardized connectors. Given the simple structure of those connectors, however, it is not possible to dedicate any one connector wire to automated device detection. Thus, it would be advantageous if automated device detection could be accomplished by means employing a standardized device connector.

Figure 3:
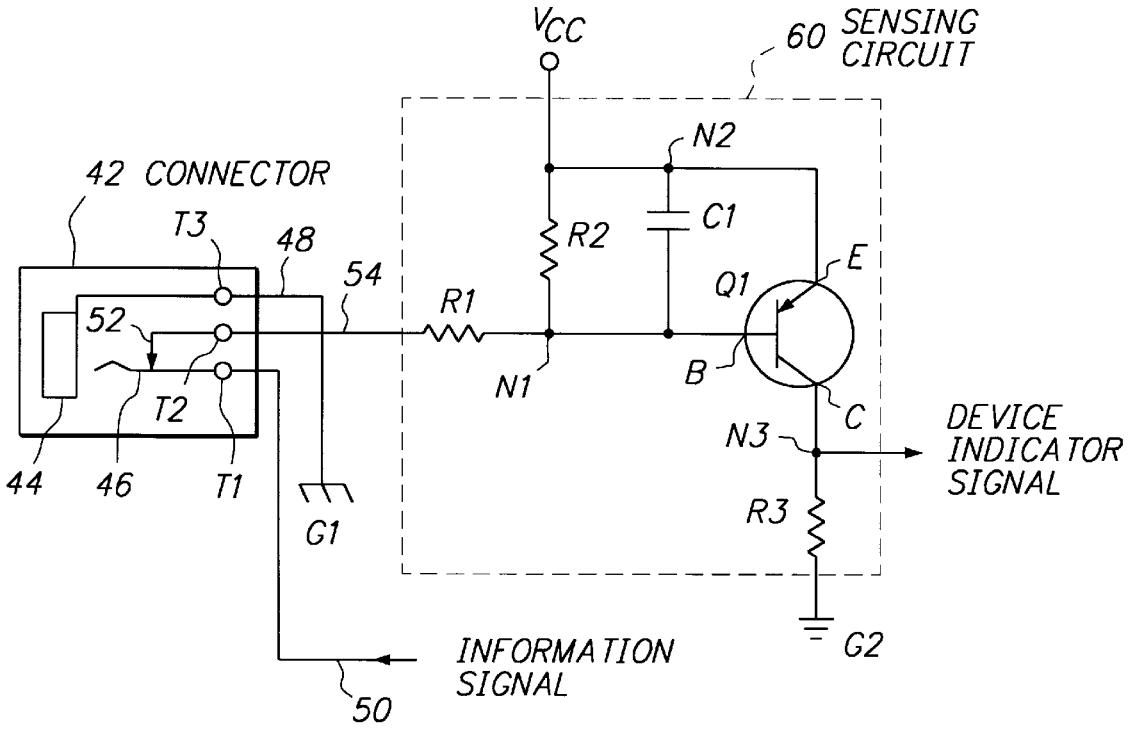
FIG. 3 represents a sensor constructed in accordance with an embodiment of the present invention.

FIG. 3 depicts a device sensor constructed in accordance with an embodiment of the present invention. The device sensor comprises a female, or receiving, connector 42 and a sensing circuit 60. As depicted, the receiving connector 42 is consistent with the connector of FIG. 2-*b*. Thus, an information signal, such as a video signal, may be provided by a signal source, such as a computer processor, to the transmission wire 50 and to a peripheral device, such as a video display, having an associated mating connector which can be inserted into the receiving connector 42. As described previously, when a mating connector is inserted into the receiving connector 42, the video signal provided on the transmission wire 50 passes to the connected peripheral device and does not pass through to the contact wire 54. However, when no mating connector is inserted, the video signal passes through the point contact 52 to the contact wire 54.

As shown in FIG. 3, the sensing circuit 60 comprises an input resistor R1 which is connected at one end to the receiving connector 42 by means of the contact wire 54. The input resistor R1 is connected at its opposite end to a base contact B of a switching transistor Q1 to form a first node N1 of the sensing circuit 60. An emitter contact E of the switching transistor Q1 is connected to a supply voltage $V_{CC}$, typically 5 Volts, to form a second node N2 of the sensing circuit 60. Also, a collector contact C of the switching transistor Q1 is connected to a grounding resistor R3 to form a third node N3 of the sensing circuit 60. The grounding resistor R3 is connected at its opposite end to a circuit ground G2. The sensing circuit 60 also includes a pullup resistor R2 and a filtering capacitor C1 connected in parallel between the first node N1 and the second node N2. A voltage arising at the third node N3 serves as an output device indicator signal of the sensing circuit 60.

In operation, the sensing circuit 60 generates the device indicator signal at two logic levels which respectively indicate whether a mating connector is received within the receiving connector 42, and therefore whether a peripheral device is present. Thus, the device sensor of the present invention provides automatic device detection without requiring that a specialized connector be constructed. Instead, the transmitted information signal is used to accomplish device detection.

An information signal such as a video signal is an AC waveform in which the amplitude of the signal alternately deviates from a fixed DC offset. Therefore, when no mating connector is inserted into the receiving connector 42, the information signal is present at the contact wire 54 and a nominal voltage of R1/(R1+R2) * $V_{CC}$ arises at the first node N1. Because the information signal alternately deviates from its DC offset, the voltage arising at the first node N1 tends to deviate proportionally from its nominal level. However, the capacitor C1 passes any AC component arising at the first node N1 through to the second node N2 and holds the first node N1 at its nominal level. In a sense, the pullup resistor R2 and the capacitor C1 serve as a low-pass filter, passing only a DC signal to the base contact B of the PNP-type switching transistor Q1. The second node N2 is also fixed at a DC level, namely $V_{CC}$, by the voltage source supplying power to the sensing circuit 60.

Resistor values R1 and R2 are readily chosen so that the nominal voltage drop from the second node N2 to the first node N1 is sufficient to forward bias an emitter-base junction E-B of the switching transistor Q1. In fact, resistor values R1 and R2 can easily be chosen so that the switching transistor Q1 saturates, or turns on, and allows current to flow from the second node N2 to the third node N3 through an emitter-collector junction E-C of the transistor Q1. Current then also flows through the grounding resistor R3, and because an emitter-to-collector voltage drop from the second node N2 to the third node N3 is relatively small, the third node N3 is "pulled up" to a DC level slightly less than $V_{CC}$. Since $V_{CC}$ is typically 5 Volts, the voltage at the third node N3 usually corresponds to a TTL logic high level. In sum, when no mating connector is inserted into the receiving connector 42, the sensing circuit 60 generates a device indicator signal at a TTL logic "one" level.

When a mating connector is inserted into the receiving connector 42, the information signal passes to the connected peripheral device and does not pass through to the contact wire 54. Thus, the voltage at the first node N1 "floats up" to level $V_{CC}$, and the voltage drop from the second node N2 to the first node N1 is insufficient to forward-bias the emitter-base junction E-B of the switching transistor Q1. Therefore, the switching transistor Q1 turns off, and no emitter-collector current flows from the second node N2 to the third node N3. As a result, no current flows through the grounding resistor R3, and the third node N3 "drops" to the level of the circuit ground G2, corresponding to a TTL logic low level. In sum, when a mating connector is inserted into the receiving connector 42, the sensing circuit 60 generates a device indicator signal at a TTL logic "zero" level.

As the above description of the preferred embodiment makes clear, the present invention satisfies the need for a method and an apparatus by which a first device may detect the presence of a second device without requiring the use of a specialized connector. Generally, the present invention employs a standard-format connector in a novel way so that an existing information signal to be supplied to a peripheral device is used as an indicator of the presence or absence of that device. Although this detailed description has been developed with respect to video display devices, the present invention is readily applicable to any electronic device to which an information signal is provided. In fact, a straightforward variant of the present invention could be used to detect the presence or absence of a peripheral device transmitting, rather than receiving, an information signal. Also, though the description of the preferred embodiment discloses a particular circuit configuration for sensing circuit 60, all other analogous configurations are also contemplated. For example, an NPN-type switching transistor may be used in combination with appropriate RC elements so that the two logic levels generated by sensing circuit 60 are reversed in polarity. In other words, the foregoing detailed description of the present invention is by way of illustration only and is not to be taken by way of limitation, the spirit and scope of the invention being limited only by the terms of the appended claims.

What is claimed is:

1. A sensor for detecting the presence of a device, comprising:

a receiving connector for receiving a mating connector associated with said device, to electrically and physically connect said device to said sensor device, said receiving connector including a terminal for conducting an information signal associated with said device; and a sensing circuit connected to said terminal for detecting whether said information signal is absent from said terminal and for generating a signal which indicates when a mating connector is received within said receiving connector in dependence upon whether said information signal is detected at said terminal, said sensor comprising:

a low-pass filter connected to a switching transistor, coupled between a first node corresponding to a base of said switching transistor and a second node corresponding to one of a collector and emitter of said switching transistor, for generating a signal at two logic levels which respectively indicate whether or not a mating connector is received within said receiving connector, and thus whether said device is present.

2. The sensor of claim 1 wherein said information signal is a video signal.

3. The sensor of claim 1 wherein said device is a video display.

4. The sensor of claim 1 wherein said receiving connector comprises an RCA jack.

5. The sensor of claim 1 wherein said logic levels are TTL compatible voltages.

6. The sensor of claim 1 wherein said sensing circuit generates a first logic level when said information signal is detected at said terminal and generates a second logic level when said information signal is not detected at said terminal.

7. The sensor of claim 6 wherein said first logic level corresponds to a TTL logic one and said second logic level corresponds to a TTL logic zero.

8. A sensor to which an information signal is provided, for detecting the presence of a device, comprising:

a receiving connector for receiving a mating connector associated with said device, to electrically and physically connect said device to a source of an information signal, said receiving connector including a first terminal to which said information signal is applied, and a second terminal that is selectively disconnected from said first terminal in dependence upon when a mating connector is received within said receiving connector; and a sensing circuit connected to said second terminal for detecting when said information signal is absent from said second terminal and for generating a signal which indicates when a mating connector is received within said receiving connector, in dependence upon whether said information is detected at said second terminal, said sensing circuit comprising:

a low-pass filter connected to a switching transistor, coupled between a first node corresponding to a base of said switching transistor and a second node corresponding to one of a collector and emitter of said switching transistor, for generating a signal at two logic levels which respectively indicate whether or not a mating connector is received within said receiving connector, and thus whether said device is present.

9. The sensor of claim 8 wherein said information signal is a video signal.

10. The sensor of claim 8 wherein said device is a video display.

11. The sensor of claim 8 wherein said receiving connector comprises an RCA jack.

12. The sensor of claim 8 wherein said logic levels are TTL compatible voltages.

13. The sensor of claim 8 wherein said sensing circuit generates a first logic level when said information signal is detected at said second terminal and generates a second logic level when said information signal is not detected at said second terminal.

14. The sensor of claim 13 wherein said first logic level corresponds to a TTL logic one and said second logic level corresponds to a TTL logic zero.

* * * * *